United States Patent [19]

Fink

[11] 4,108,084

[45] Aug. 22, 1978

[54] CHILD'S SHELF AND GARMENT HANGER RACK

[76] Inventor: Robert Fink, 6780 Tanglewood Dr., Youngstown, Ohio 44512

[21] Appl. No.: 661,345

[22] Filed: Feb. 25, 1976

[51] Int. Cl.[2] ..... A47B 41/04

[52] U.S. Cl. ..... 108/29; 108/31; 108/149; 211/117

[58] Field of Search ..... 108/149, 29, 31; 211/117

[56] References Cited

U.S. PATENT DOCUMENTS

| | | | |
|---|---|---|---|
| 1,331,621 | 2/1920 | Carlin | 108/149 X |
| 2,051,241 | 8/1936 | Biggers | 108/149 |
| 2,193,215 | 3/1940 | Witter | 211/117 X |
| 2,480,327 | 8/1949 | Idelsohn | 211/113 |
| 2,645,357 | 7/1953 | Taylor et al. | 211/117 |
| 2,645,547 | 7/1953 | Channer, Jr. | 108/149 X |
| 3,139,045 | 6/1964 | Rojakovick | 108/149 X |
| 3,610,426 | 10/1971 | Thomas | 211/117 |

FOREIGN PATENT DOCUMENTS

| | | | |
|---|---|---|---|
| 26,980 of | 1897 | United Kingdom | 108/29 |
| 448,567 | 6/1936 | United Kingdom | 108/149 |

*Primary Examiner*—Roy D. Frazier
*Assistant Examiner*—Peter A. Aschenbrenner
*Attorney, Agent, or Firm*—Webster B. Harpman

[57] ABSTRACT

A shelf and garment hanger rack for childrens' clothes, hat and gloves is adjustably suspended from a garment hanger bar in a clothes closet, and positions the shelves and a garment hanging bar in relatively low location in the clothes closet so that they can be easily reached by a small child.

1 Claim, 3 Drawing Figures

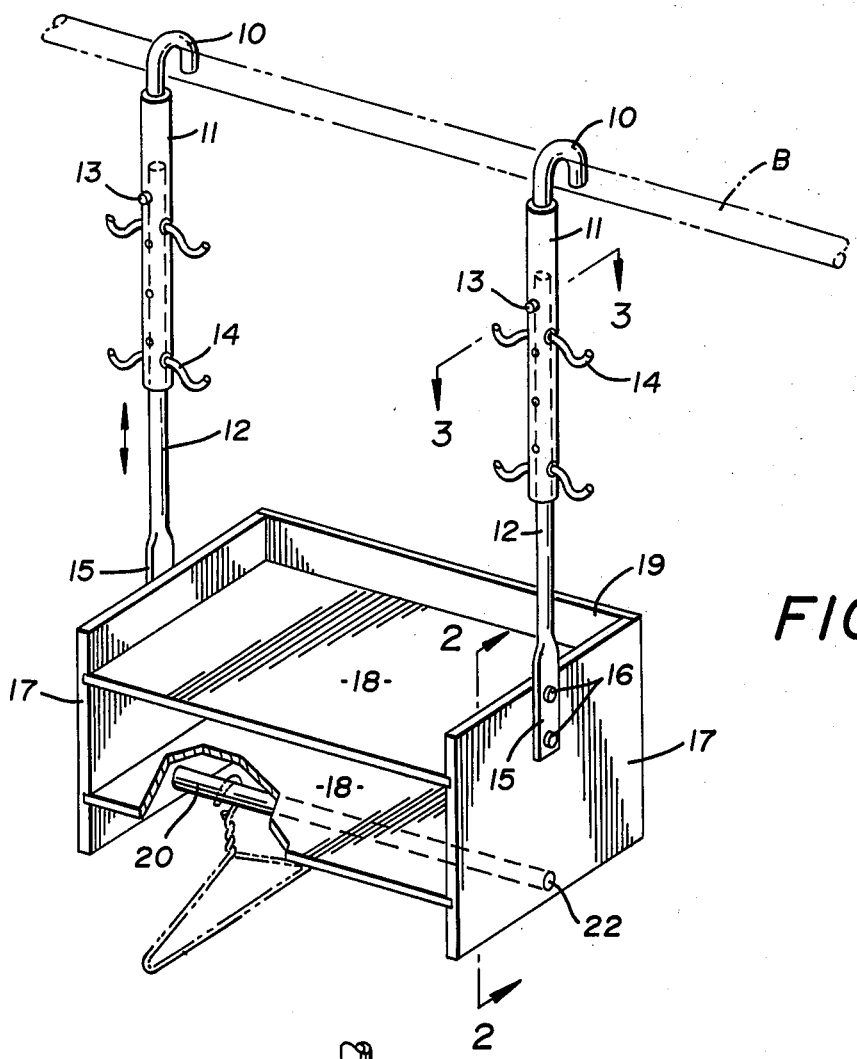
FIG. 1
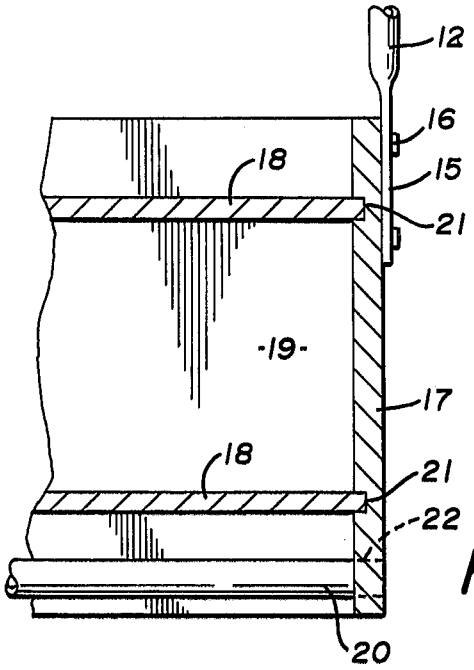
FIG. 2
FIG. 3
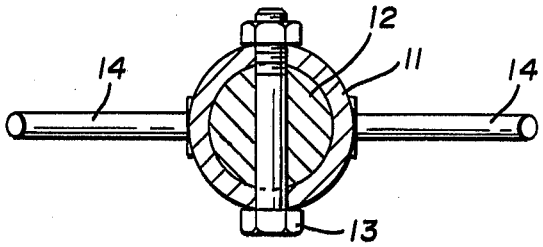

CHILD'S SHELF AND GARMENT HANGER RACK

BACKGROUND OF THE INVENTION (1) Field of the Invention:

This invention relates to childrens' garment racks positioned in clothes closets below the usual garment hanging bars therein.

(2) Description of the Prior Art:

Prior structures of this type have generally provided a garment hanger bar and means suspending it in a clothes closet such as seen for example in U.S. Pats. Nos. 2,480,327, 2,645,357 and 3,610,426. In U.S. Pat. No. 2,480,327 a garment hanger bar is suspended in fixed relation to a conventionally positioned bar in a clothes closet. In U.S. Pat. No. 2,645,357 a triangularly shaped member is adjustably positioned on a straight portion of an elongated hook and in U.S. Pat. No. 3,610,426 straps with conventional buckles permit vertical adjustment of a garment hanger bar with respect to a conventionally positioned hanger bar thereabove.

The present invention discloses a combination shelf unit and garment hanger bar with adjustable supports extending thereabove permitting the shelves and garment hanger bar to be positioned at a lower level where they are conveniently accessible to a small child.

SUMMARY OF THE INVENTION

A shelf and garment hanger rack for a child's clothing, hats, books, gloves and the like has a pair of shelves complete with oppositely disposed sides and a back portion suspended by a pair of vertically adjustable members enabling it to be positioned at a relatively lower level in a clothes closet and suspended from a garment hanger bar therein. A secondary garment hanger bar is positioned in the lower portion of the unit below the shelves to provide for the reception of garment hangers on which a child's clothing may be hung. The arrangement is such that the shelf and garment hanger rack may be positioned at one side of a clothes closet with the back of the shelf portion thereof in substantially flush relation to the back wall of the clothes closet where it will provide conveniently accessible shelves and a garment hanger bar for a child.

DESCRIPTION OF THE DRAWINGS

FIG. 1 is a perspective elevation of the shelf and garment hanger rack with parts broken away and parts in cross section;

FIG. 2 is an enlarged cross sectional detail on line 2—2 of FIG. 1; and FIG. 3 is an enlarged horizontal section on line 3—3 of FIG. 1.

DESCRIPTION OF THE PREFERRED EMBODIMENT

By referring to the drawings and FIG. 1 in particular it will be seen that a pair of hooks 10 are shown positioned over a broken line representation of a hanger bar B such as found in a clothes closet in a dwelling house or apartment. Tubular longitudinally extending apertured members 11 depend from the hooks 10 and telescopically receive apertured rods 12 which are positioned in desired location in the tubular members 11 by fasteners 13. The tubular members 11 may be provided with a plurality of hooks 14 if desired. The lower ends of the apertured rods 12 are flattened as at 15 and fasteners 16 engage side panels 17 of a shelf assembly including a pair of horizontally disposed shelves 18. The side panels 17 of the shelf assembly extend above and below the upper and lower shelves 18 which are themselves vertically spaced and a back panel 19 completes the shelf assembly.

Still referring to FIG. 1 of the drawings it will be seen that the upper shelf 18 in the shelf assembly is thus provided with side and back walls so that articles positioned thereon will be more easily retained thereby. The lower portions of the side panels 17 extend below the lower shelf 18 and receive and position a garment hanger bar 20. A broken line representation of a garment hanger 21 is shown with its hook portion positioned over the garment hanger bar 20 and it will be seen that the garment hanger bar 20 is located considerably below the garment hanger bar B shown in broken lines at the uppermost portion of FIG. 1 and it will be obvious to those skilled in the art that the shelf assembly, including the shelves 18 and the garment hanger bar 20 are thus conveniently positioned at a low enough level to be readily accessible to a child and it will be seen that as the child grows the entire shelf assembly and the garment hanger bar 20 may be moved upwardly by changing the relative engagement of the rods 12 in the apertured tubular members 11 of the device.

By referring now to FIG. 2 of the drawings it will be seen that the side panels 17 are preferably provided with vertically spaced horizontally disposed parallel grooves 21 in which the ends of the shelves 18 which are rectangular are positioned and it will be seen that the lower portions of the side panels 17 are provided with openings 22 in which the ends of the garment hanger bar 20 are positioned so that the child's shelf and garment hanger rack can be shipped, knocked down and easily assembled at the point of use.

In FIG. 3 of the drawings a cross sectional detail of one of the apertured tubular members 11 and its telescopically arranged apertured rod 12 may be seen together with the fastener 13 which takes the form of a nut and bolt assembly.

Although but one embodiment of the present invention has been illustrated and described, it will be apparent to those skilled in the art that various changes and modifications may be made therein without departing from the spirit of the invention, and having thus described my invention what I claim is:

1. In a child's shelf and garment hanger rack the combination of a pair of vertically spaced horizontally disposed shelves and end members positioned on and secured to the opposite ends of said shelves and extending below and above said shelves, a bar positioned between and supported on said end members below said shelves in spaced parallel relation to said shelves and upstanding longitudinally adjustable support members on said end members midway between the front and back edges thereof, garment hanging members carried by said support member and means for suspending said support members and said shelves from a clothes hanger bar in a clothes closet, said means comprising hook configurations on the upper ends of said adjustable support members said end members take the form of side panels and a back panel is secured to said side panels and to one edge of each of said shelves and wherein the back panel extends above said shelves to register with said end members.

* * * * *